US006042165A

United States Patent [19]

Thompson

[11] Patent Number: 6,042,165

[45] Date of Patent: Mar. 28, 2000

[54] PICK-UP BOX LIFT

[76] Inventor: Irvin Thompson, N14402 650$^{th}$ St., Ridgeland, Wis. 54763

[21] Appl. No.: 09/436,815

[22] Filed: Nov. 9, 1999

[51] Int. Cl.$^{7}$ ..... B66C 1/66

[52] U.S. Cl. ..... 294/67.32; 294/67.1; 294/81.2; 294/81.5; 294/97

[58] Field of Search ..... 294/67.1, 67.3–67.33, 294/67.5, 81.1, 81.2, 81.21, 81.5, 81.52, 81.55, 81.56, 90, 93, 95, 97, 106, 118; 254/133 R; 414/607, 608, 626

[56] References Cited

U.S. PATENT DOCUMENTS

| | | | |
|---|---|---|---|
| 529,840 | 11/1894 | Roesen . | |
| 2,020,174 | 11/1935 | Derossi | 294/81.55 |
| 3,424,488 | 1/1969 | Renfroe | 294/67.32 |
| 3,437,369 | 4/1969 | Gealy | 294/67.32 |
| 3,972,553 | 8/1976 | Johnston | 294/81.5 X |
| 4,826,228 | 5/1989 | Dinitz et al. | 294/81.2 X |
| 5,207,795 | 5/1993 | Sato et al. | 294/74 |
| 5,306,062 | 4/1994 | Dodge | 294/81.21 |
| 5,486,083 | 1/1996 | Thompson | 294/97 X |
| 5,803,520 | 9/1998 | Bagrowski, III | 294/67.33 |

*Primary Examiner*—Johnny D. Cherry
*Attorney, Agent, or Firm*—Anthony J. Bourget

[57] ABSTRACT

A lifting apparatus used together with a standard engine hoist for lifting a pick-up box from the chassis of a pick-up truck. The apparatus comprises two support members in a pivotal relationship where each support member has two ends, and where the support members are adjustable for opening for use and closing for storage. The support members are connected at their mid-points with a lift pin. The lift pin is adapted for receiving a chain or hoist for lifting the apparatus. Near the end of each support member is pivotally connected a contact member for engagement underneath the ridge of a standard pick-up box. A chain device may be attached between the lift pin and the engine hoist so that an operator may easily and safely lift the pick-up box from the truck chassis.

12 Claims, 5 Drawing Sheets

PICK-UP BOX LIFT

FIELD OF THE INVENTION

This invention relates to a lifting apparatus and more particularly to an apparatus for use in hoisting and removal of pick-up truck boxes. The apparatus is particularly useful in conjunction with an engine hoist or other hoist for the removal of a pick-up bed or pick-up box.

DESCRIPTION—BACKGROUND OF PRIOR ART

To repair or work on a pick-up sometimes requires removal of the pick-up bed or box which is attached to the pick-up chassis. The pick-up box is bulky and may weight several hundred pounds, thus generally requiring the assistance of more than a few persons in lifting and removal of the pick-up box. This poses difficulty for smaller repair shops which do not have persons available to assist in lifting and removal of the pick-up box. Absent having a customized lift or hoist cables, it is difficult and inconvenient for the smaller shop or single worker to lift and remove the pick-up box.

Most repair shops, however, do have engine hoists or cranes for removal of engines from cars and trucks. While such hoist is ideal for use in the shop, it cannot be easily connected to the pick-up box for lifting and removal of the pick-up box. Various devices have been designed so that a single worker can, with the assistance of an engine crane, remove the truck bed with comparative ease. U.S. Pat. No. 5,803,520 to Bagrowski III discloses a fixture for hoisting and removal of truck beds with the use of an engine hoist. Applicant has found such device to be unduly complicated and cumbersome for use, and lacking other unique features specific to the present invention.

Accordingly, it is an object of the present invention to provide an apparatus for hoisting and removal of pick-up boxes. It is a further object of this invention to provide a pick-up box lift which may be used in conjunction with a standard engine hoist, which is easily attachable and detachable, is easily transportable and storable, is easily adjustable to operate with a variety of pick-up boxes, and which overcomes the limitations and shortcomings of the prior art.

BRIEF SUMMARY OF THE INVENTION

The apparatus of the present invention provides for lifting a pick-up box having a ridge. In a basic aspect, the invention provides two support members in a pivotal relationship, with each support member having two opposing ends. The apparatus includes a lift pin connecting the two support members, where the lift pin is adapted for receiving a hoist for lifting the apparatus. A contact member is pivotally connected near each of the ends of the two support members so that when the contact members are positioned underneath the ridge of the pick-up box, the pick-up box is lifted when the apparatus is lifted at the lift pin by the engine hoist.

In a preferred embodiment, the invention includes one of the support members having risers. The lifting apparatus may include the lift pin connecting at a mid-point of each support member. Additionally, the contact members extend upward from the support members. The apparatus is lowered into the truck body with the support members pivoted so as to position the contact members beneath the pick-up box ridge. The contact members contact the truck box when the apparatus is hoisted, thereby lifting the truck box.

The features, benefits and objects of this invention will become apparent to those skilled in the art by reference to the following description, claims and drawings.

DETAILED DESCRIPTION OF THE PREFERRED EMBODIMENTS

Figure 1:
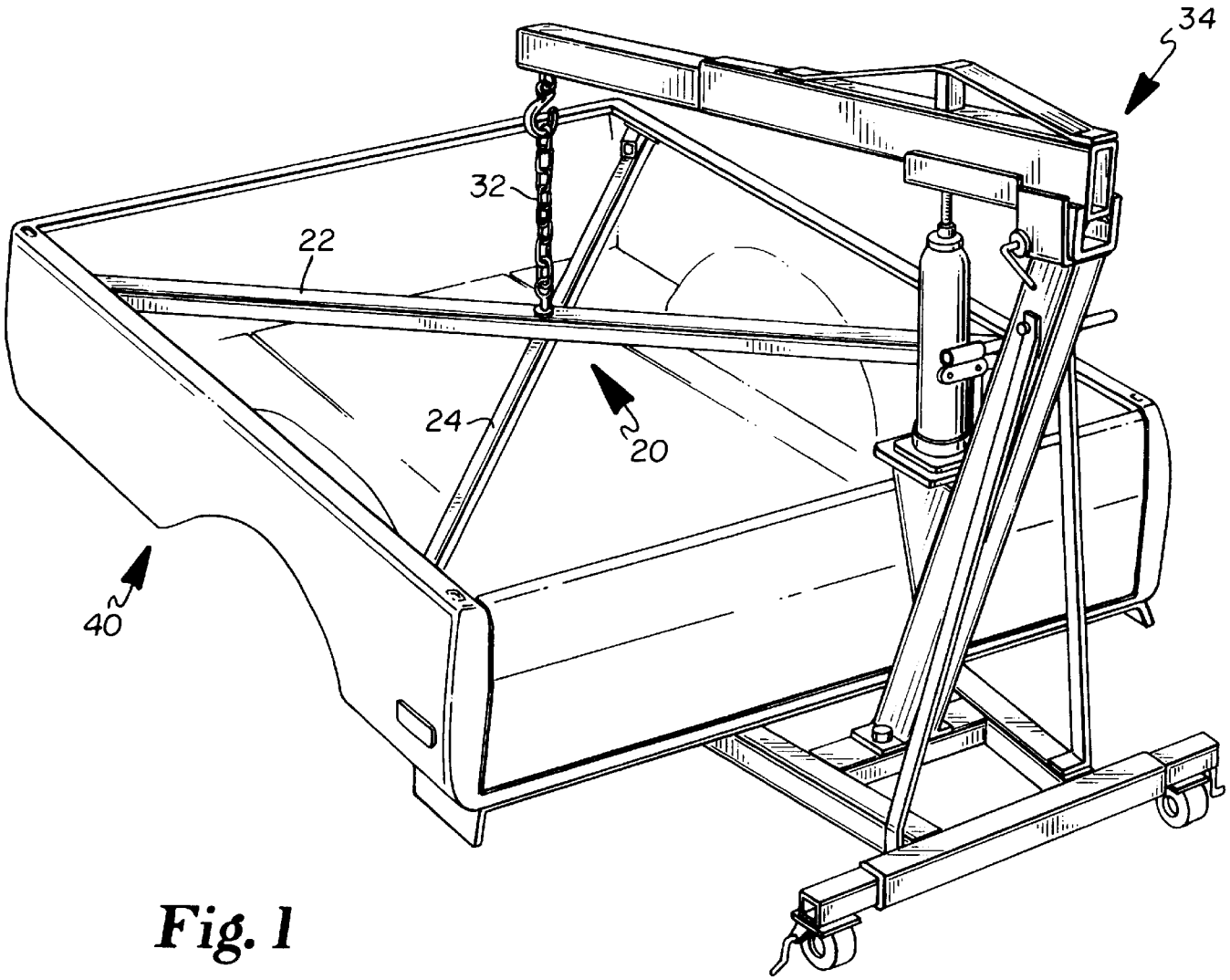
FIG. 1 is a perspective view of the lifting apparatus operatively positioned with an engine hoist and truck box.

In referring to the drawings wherein like numerals represent like parts throughout the several views, FIG. 1 represents use of lift 20 of the present invention in conjunction with a standard hoist or engine crane 34. Lift 20 is positioned within pick-up box 40 as shown. Lift 20 has a pair of support members 22 and 24. Each of the support members is preferably made of rectangular steel tubing or other solid support material. The dimensions of each support member are preferably 2 inches by 1.5 inches by 80 inches. Such dimension allows the lift 20 to operate with mid-size or full-size pick-up boxes. Using a length less than 80 inches will accommodate the lift for use in smaller sized pick-up boxes.

Figure 3:
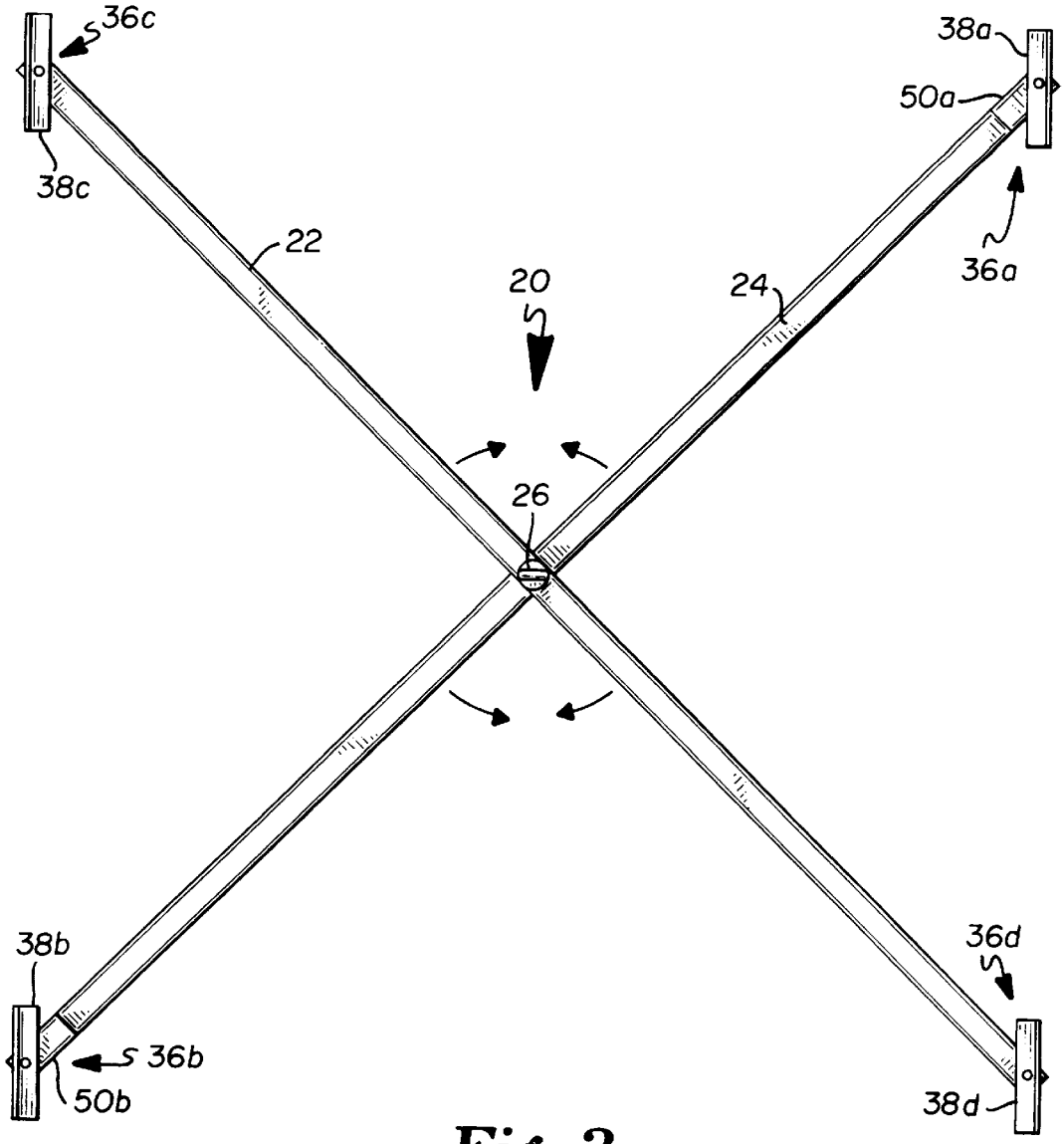
FIG. 3 is a top plan view of the apparatus of the present invention.
Figure 4:
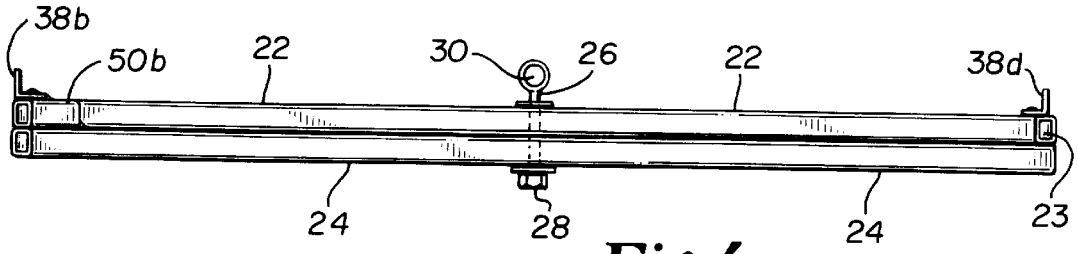
FIG. 4 is a front end plan view of the apparatus of the present invention.

As shown in FIGS. 3 and 4, support members 22 and 24 are pivotally connected to each other with lift pin 26. Lift pin 26 extends through each of support members 22 and 24 as shown in FIG. 4. Lift pin 26 preferably connects at a mid-point of each support member 22 and 24. Lift pin nut 28 secures lift pin 26 in position. Lift pin nut 28 is preferably of the self-locking variety. Lift pin 26 is preferably an eye bolt having an eye 30 for receiving a lifting chain 32 or hoist 34. Lift pin 26 is preferably a ⅜ inch eye bolt.

Figure 2:
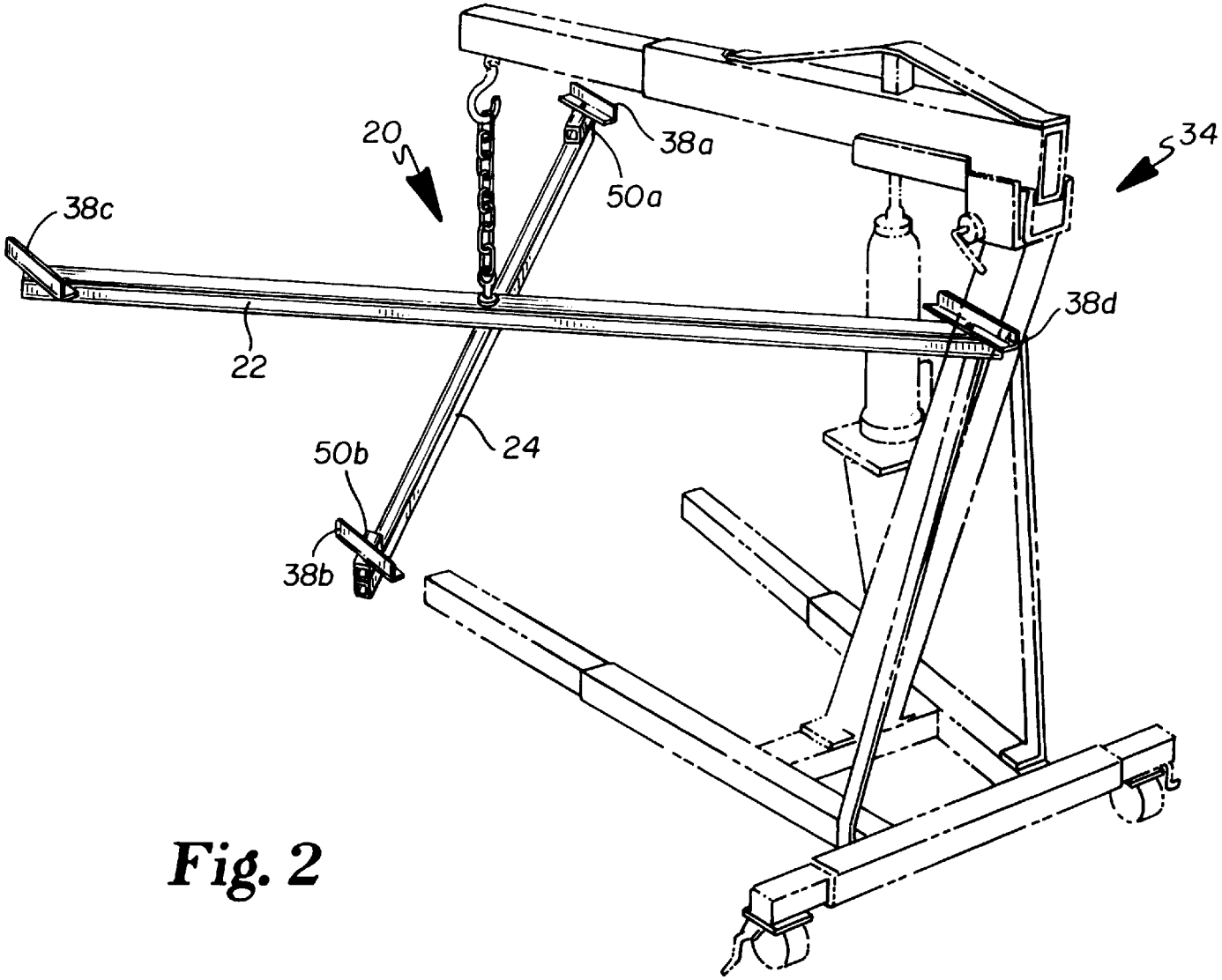
FIG. 2 is a perspective view of the lifting apparatus operatively positioned with an engine hoist depicted in phantom.
Figure 7:
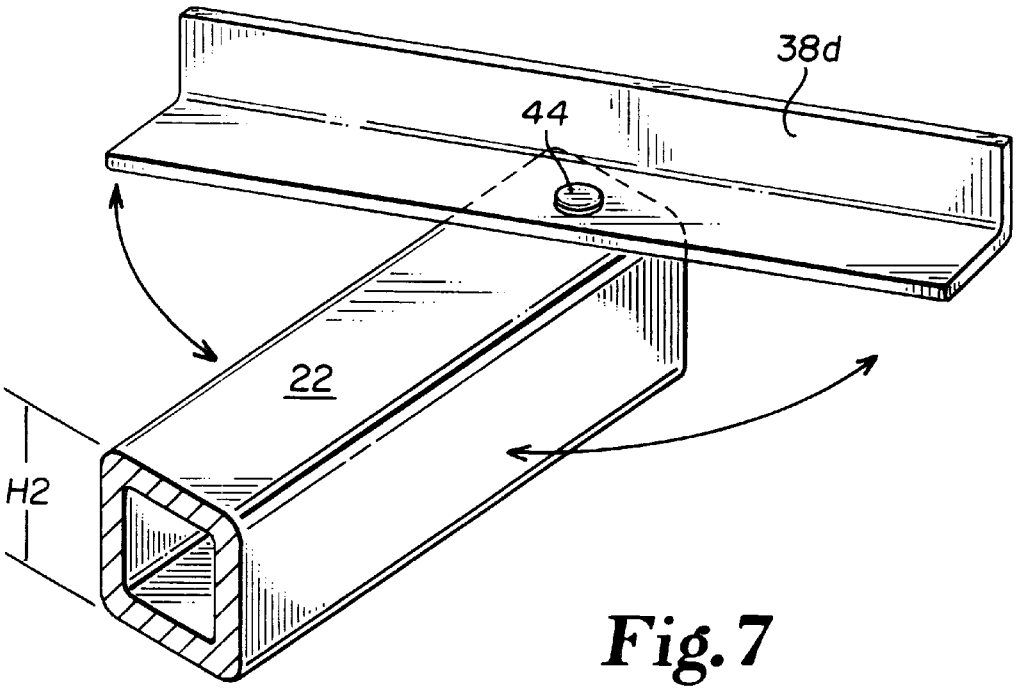
FIG. 7 is a detail view of a support member and pivotal contact member.

As shown in FIG. 3, each of the support members 22 and 24 has two support member ends 36*a–d*. Near each of the support member ends 36 is positioned a contact member 38*a–d*. Contact members 38 are preferably pivotally connected at each of the support member ends 36. Each of the contact members 38 is preferably made of a steel angle piece having substantially L-shaped cross sections. The dimensions of the contact members 38 are preferably 1.5 inches by 1.5 inches by 8 inches, and made of ⅛ inch steel. Each of the contact members 38 is rotatably connected to the respective support members as shown in FIGS. 3 and 7, preferably with use of a ⅜ inch hex bolt and nut. Contact members 38 are preferably positioned on the respective support members 22 and 24 to extend upward from the support members. Having contact members 38 extend upward offers strength and mechanical support as opposed to having such members extend downward. In the upward extension configuration, contact members 38 abut support members 22 and 24 for additional support, whereas a downward extension would require support to be focused on bolt 44. FIG. 2 further shows lift 20 of the present invention in conjunction with hoist 34, and depicts alignment of contact members 38.

Figure 6:
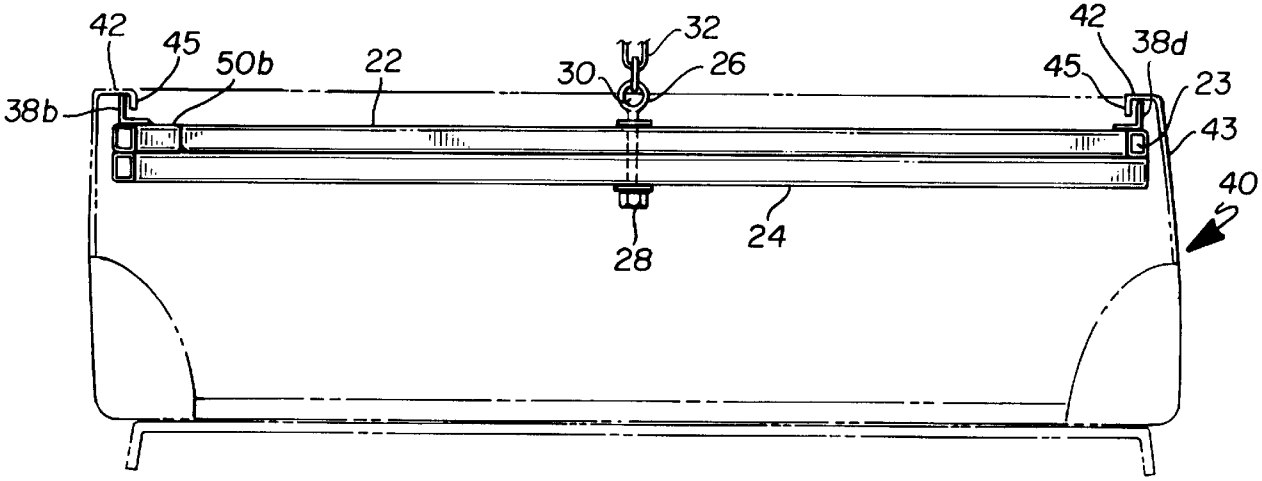
FIG. 6 is an end view of the apparatus with the truck box shown in phantom.

In operation, lift 20 is positioned within pick-up box 40 as shown in FIGS. 1 and 6. Pick-up box 40 includes ridge 42 as shown in FIG. 6. Contact members 38 are positioned beneath and in contact with ridge 42. Ridge 42 is formed about the open part or perimeter of a pick-up box. Cargo is generally loaded within the open part of the box. When hoist 34 is activated, pick-up box 40 is lifted from the chassis of the pick-up. Pick-up box 40 may then be removed and placed in a position so the worker may operate on or repair the remainder of the pick-up or the pick-up box.

Referring to FIG. 7, support member 22 includes contact member 38*d*. Contact member 38*d* is pivotally connected by use of hex bolt 44. Contact member 38*d* is configured to rotate 360 degrees in either direction of the arrows shown. Such rotation allows contact member 38 to be properly positioned underneath ridge 42 to obtain proper alignment under the ridge and to provide a stable contact with the pick-up box.

Lift 20 may be used with a variety of sizes of pick-up boxes. The preferred dimensions described herein fit mid-sized or full-sized pick-up boxes. As support members 22 and 24 pivot, they operate in a scissors-like fashion to fit various pick-up boxes. As support members 22 and 24 adjust in the direction of the arrows shown in FIG. 3, lift 20 realizes a narrowed profile for fitting within a narrower pick-up box. With such adjustment, the respective contact members 38 are appropriately rotated to provide a proper and secure fit beneath ridge 42. Accordingly, having support members 22 and 24 pivot in relationship to each other, in conjunction with contact members 38 which also rotate, allows lift 20 to be secured with a variety of pick-up boxes. Such dual rotation is easy to achieve for a single worker who is aligning lift 20 within the box. For wider dimensioned boxes, support members 22 and 24 are adjusted in the direction opposite the arrows shown in FIG. 3.

Figure 5:
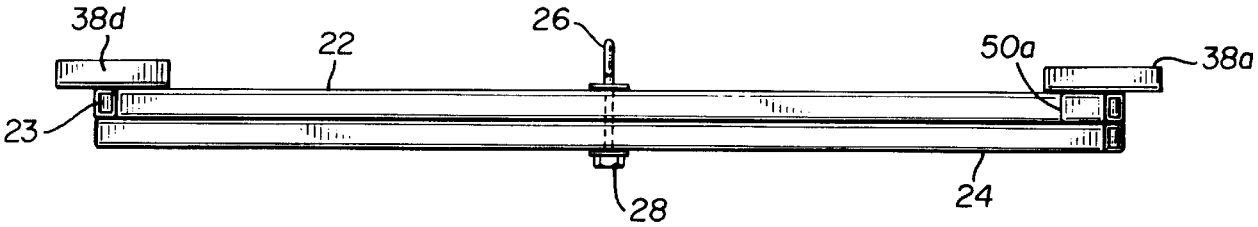
FIG. 5 is a side plan view of the apparatus of the present invention.

Support member 22 preferably includes member opening 23 as shown in FIG. 5. Member opening 23 runs the length of support member 22 as support member 22 is hollow or made of rectangular tubing.

Figure 8:
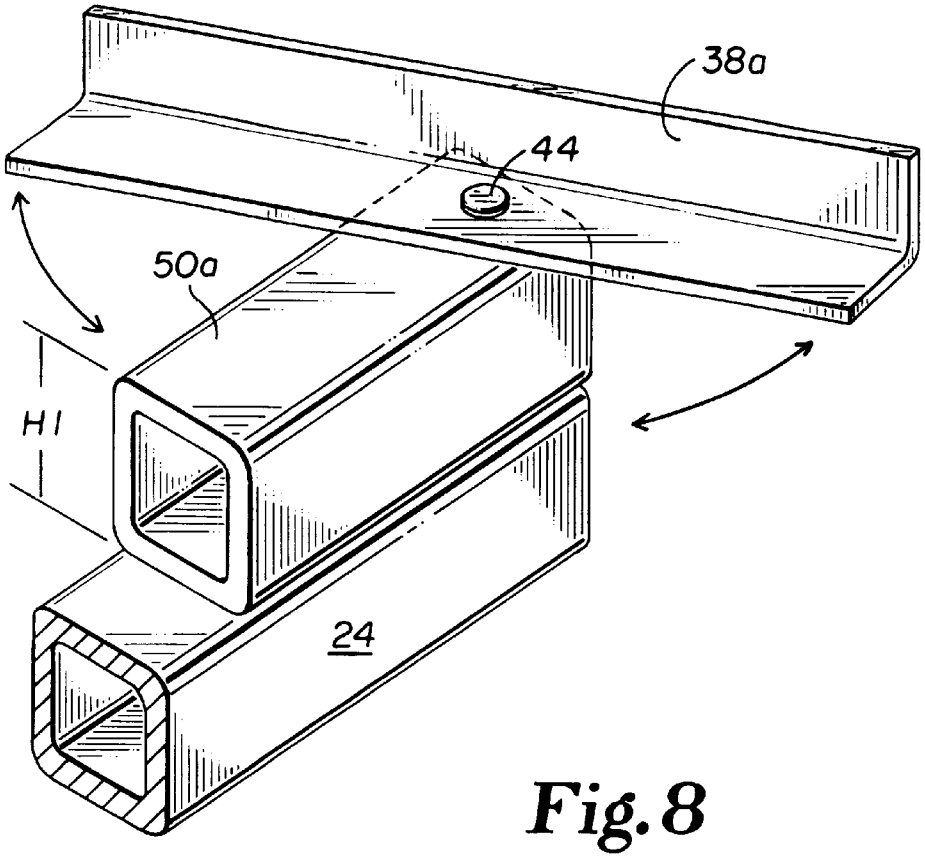
FIG. 8 is a detail view of a support member together with a riser and pivotal contact member.

Arranging support members 22 and 24 in the pivotal relationship as shown requires that support member 22 be placed above support member 24. Such relationship does not provide an even horizontal plane upon which contact members 38 can be positioned to provide simultaneous contacts underneath the ridge. Thus, a gap exists between contact members 38 and the respective ridge portions under which the contact members 38*a* and 38*b* are positioned. In a preferred embodiment, lift 20 includes risers 50*a* as shown in detail in FIG. 8. Contact member 38*a* is pivotally connected to riser 50*a* with hex bolt 44. Such configuration allows contact member 38*a* to rotate at 360 degrees about hex bolt 44. Hex bolt 44 may run through and connect contact member 38*a*, riser 50*a*, and support member 24*a*. Risers 50 are preferably connected flush with the end of each respective support member 22 and 24 as shown in FIG. 8. Risers 50 are preferably made of steel 14 gauge material and include a cross sectional dimension substantially identical to support members 22 and 24. Preferably, risers 50 have dimensions of 2 inches by 1.5 inches and are made of rectangular steel tubing. Risers 50 preferably have a length of approximately 3 inches. Risers 50*a* preferably have a height dimension H1 substantially equivalent to the height dimension H2 of support member 22. With risers 50*a* and 50*b* in place, lift 20 is provided an even horizontal plane so that contact members 38 can be positioned to make simultaneous contacts underneath ridge 42. The gap is therefore eliminated and lift 20 can simultaneously receive forces located near the four corners of the pick-up box. Such configuration provides additional balance for lifting and removing the box. In such configuration, a single worker may operate the hoist 34 in order to lift up the pick-up box 40.

Lifting chain 32 is preferably of the welded link variety and 5/16 inches by 12 inches long to accommodate ease and standard connection with hoist 34. Lifting chain 32 is generally used to connect lift 20 to hoist 34.

When lift 20 is lifted, support members 22 and 24 resist pivotal adjustment which might otherwise tend to make support members 22 and 24 fold together. Instead, contact members are securely configured within the channel of the box, defined by the ridge 42, outer wall 43, and lip 45 as shown in FIG. 6. Lip 45 extends downward approximately one inch or more from ridge 42 to inhibit contact member 38 from inward movement. While it is preferable that the pick-up box include a lip 45, it can be appreciated that lift 20 may operate in situations where lip 45 is absent.

When lift 20 is not in operation, it may be adjusted or compressed by aligning support members 22 and 24 in a relatively straight line configuration. Lift 20 may therefore be tucked upright in a corner, laid on the floor adjacent a wall, or placed in some other out of the way position. Moreover, the nut and bolt assemblies are easily dismantled so as to conveniently package the lift components for mailing and sale.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function, it is intended that such claim be construed to cover the corresponding structure, material, or acts described in the specification and equivalents thereof, including both structural equivalents and equivalent structures.

I claim:

1. A lifting apparatus for lifting a pick-up box having a ridge, said apparatus comprising:

two support members in a pivotal relationship, each support member having two ends;

a lift pin connecting said support members, said lift pin being adapted for receiving a hoist for lifting said apparatus; and a contact member pivotally connected near each end;

wherein each of said contact members is positioned underneath the ridge of the pick-up box so that the pick-up box is lifted when said apparatus is lifted at said lift pin.

2. A lifting apparatus according to claim 1 wherein one of said support members includes a riser.

3. A lifting apparatus according to claim 2 wherein said riser has a height substantially equivalent to a height of said support member.

4. A lifting apparatus according to claim 2 wherein said riser has a height substantially equivalent to a height of the other of said support members.

5. A lifting apparatus according to claim 1 wherein said lift pin connects at a mid point of each support member.

6. A lifting apparatus according to claim 1 wherein each of said contact members extends upward from said support members.

7. A lifting apparatus according to claim 1 wherein said two support members are adjustable within a relatively horizontal plane.

8. A lifting apparatus according to claim 1 wherein said lifting pin includes an eye bolt.

9. A lifting apparatus according to claim 1 wherein each of said contact members pivotally connects at said end of a respective support member.

10. A lifting apparatus for lifting a pick-up box having a ridge, said apparatus comprising:

two support members in a pivotal relationship, each support member having two ends;

a lift pin connecting said support members, said lift pin being adapted for receiving a hoist for lifting said apparatus;

a contact member connected near each end; and positioning means for positioning said contact members underneath the ridge of the pick-up box;

wherein each of said contact members is positioned underneath the ridge of the pick-up box so that the pick-up box is lifted when said apparatus is lifted at said lift pin.

11. A lifting apparatus according to claim 10 wherein said positioning means includes a hex bolt.

12. A lifting apparatus according to claim 10 wherein said positioning means includes a riser.

* * * * *